US008114825B2

(12) United States Patent
Yokoi et al.

(10) Patent No.: US 8,114,825 B2
(45) Date of Patent: Feb. 14, 2012

(54) PHOTORESIST STRIPPING SOLUTION

(75) Inventors: Shigeru Yokoi, Kanagawa (JP); Atsushi Yamanouchi, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 177 days.

(21) Appl. No.: 12/585,973

(22) Filed: Sep. 30, 2009

(65) Prior Publication Data

US 2010/0022426 A1 Jan. 28, 2010

Related U.S. Application Data

(63) Continuation of application No. 11/431,750, filed on May 11, 2006, now abandoned.

(30) Foreign Application Priority Data

May 12, 2005 (JP) ..... 2005-140384

(51) Int. Cl.
*C11D 7/50* (2006.01)

(52) U.S. Cl. ..... 510/175; 510/176; 510/178; 510/504; 134/1.3

(58) Field of Classification Search ..... 510/175, 510/176, 178, 504; 134/1.3
See application file for complete search history.

(56) References Cited

U.S. PATENT DOCUMENTS

| | | | | |
|---|---|---|---|---|
| 6,797,682 | B2 * | 9/2004 | Hara et al. | 510/175 |
| 7,049,275 | B2 * | 5/2006 | Ikemoto et al. | 510/176 |
| 2002/0128164 | A1 * | 9/2002 | Hara et al. | 510/175 |
| 2003/0114014 | A1 * | 6/2003 | Yokoi et al. | 438/745 |
| 2003/0181344 | A1 * | 9/2003 | Ikemoto et al. | 510/175 |
| 2004/0106532 | A1 * | 6/2004 | Yokoi et al. | 510/178 |
| 2004/0256358 | A1 * | 12/2004 | Shimizu et al. | 216/83 |
| 2005/0084792 | A1 * | 4/2005 | Yokoi et al. | 430/256 |
| 2005/0176259 | A1 * | 8/2005 | Yokoi et al. | 438/745 |
| 2006/0094612 | A1 * | 5/2006 | Kimura | 510/175 |

FOREIGN PATENT DOCUMENTS

| | | |
|---|---|---|
| JP | 07-146563 | 6/1995 |
| JP | 10-239865 | 9/1998 |
| JP | 2001-215736 | 8/2001 |
| JP | 2004-133153 | 4/2004 |
| JP | 2004-177740 | 6/2004 |
| JP | 2004-264401 | 9/2004 |

* cited by examiner

*Primary Examiner* — Gregory Webb
(74) *Attorney, Agent, or Firm* — Wenderoth, Lind & Ponack, L.L.P.

(57) ABSTRACT

Disclosed is a photoresist stripping solution consisting essentially of (a) a quaternary ammonium hydroxide (e.g., tetramethylammonium hydroxide), (b) at least one water-soluble organic solvent selected from glycols and glycol ethers (e.g., propylene glycol, ethylene glycol, diethylene glycol monobutyl ether), and (c) a non-amine water-soluble organic solvent (e.g., dimethyl sulfoxide, N-methyl-2-pyrrolidone). The photoresist stripping solution of the invention has an excellent photoresist strippability, not causing damage of swelling/coloration to acrylic transparent films used in production of liquid-crystal panels and not causing damage to electrode materials. In particular, it has an excellent photoresist strippability to remove even a thick-film negative photoresist (photosensitive dry film) used in production of semiconductor chip packages (especially, wafer-level chip size packages, W-CSP), not causing damage to copper.

9 Claims, No Drawings

PHOTORESIST STRIPPING SOLUTION

This is a continuation application in Ser. No. 11/431,750, filed May 11, 2006, which is now abandoned.

BACKGROUND OF THE INVENTION

1. Field of the Invention

The present invention relates to a photoresist stripping solution. In particular, the invention relates to a photoresist stripping solution to be used in a process of producing liquid-crystal panels and a process of producing semiconductor chip packages.

2. Description of the Related Art

A liquid-crystal display such as TFT-LCD has a structure of liquid crystal sandwiched between opposite glass substrates, in which, in general, a TFT (thin-film-transistor) and a pixel electrode (transparent electrode) are formed on one glass substrate and an alignment film is superposed thereon to cover the entire surface of the substrate, while a color filter, a transparent electrode and an alignment film are laminated in order on the other glass substrate, and the glass substrates are positioned oppositely to each other with their alignment film-coated sides facing each other. In this case, the TFT is more bulky than the pixel electrode on the one glass substrate, and therefore the thickness of the liquid crystal sandwiched between the opposite glass electrodes could not be uniform, or that is, the thickness of the liquid crystal in the site corresponding to the TFT may be thereby smaller.

Accordingly, a method for making the thickness of the liquid crystal uniform has heretofore been employed, which is as follows: After a TFT is firstly formed on one glass substrate, a transparent insulating film (e.g., acrylic transparent film) is formed on the entire surface of the glass substrate to completely cover the TFT, thereby absorbing the TFT height difference to planarize the surface of the resulting substrate, and a pixel electrode (transparent electrode) is then formed on the surface-planarized acrylic transparent film, and thereafter an alignment film is superposed on the entire surface thereof.

The pixel electrode (transparent electrode) is formed as follows: A transparent conductive film is formed on an acrylic transparent film by sputtering or the like, a photoresist is uniformly applied onto it, and the photoresist is selectively exposed to light and developed to form a photoresist pattern, then the transparent conductive film is selectively etched through the photoresist pattern serving as a mask to form a pixel electrode (transparent electrode), and thereafter the photoresist pattern is stripped with a stripping solution.

Accordingly, since the stripping solution is brought into direct contact with the acrylic transparent film in the treatment of stripping the photoresist pattern, it is indispensable that the stripping solution should not have any negative influence of swelling or coloration on the acrylic transparent film. If the acrylic transparent film is swollen, then it may cause a problem in that the transparent electrode formed thereon may be inconveniently peeled; and if colored, then the acrylic film may lose its transparency.

On the other hand, in a process of fabricating semiconductor chip packages, a technique of producing wafer-level chip size packages (W-CSP) has become employed recently, in which ultra-small size, wafer-level chips are packaged all at a time for satisfying the recent multi-layer microfabrication technology in producing semiconductor devices.

The process of producing W-CSP comprises, for example, forming a conductive metal film (e.g., thin copper film) on a substrate such as a silicon wafer having a passivation film (insulating film) thereon by sputtering, providing a positive photoresist pattern on the thin copper film, and etching the thin copper film through the pattern serving as a mask to form a copper rerouting or re-wiring pattern. One or more layers of the insulating film/rerouting pattern are formed as a single-layer or multi-layer structure.

Next, a photosensitive dry film of a negative photoresist is stuck to the substrate under heat and pressure, then this is selectively exposed to light and developed to form a thick-film photoresist pattern (photocured pattern), a copper post (bump) is formed in the area not having the photoresist pattern, by plating, and thereafter the photoresist pattern is removed with a stripping solution. Next, this is sealed up with a sealant resin to cover the entire surface of the substrate so as to completely cover the copper post, and thereafter the upper part of the sealant resin and the upper part of the copper post are all cut off. A conductive terminal (copper terminal) is soldered to the top of the thuscut and exposed copper post, and thereafter the wafer is cut into individual packages.

In the process of producing packages, the negative photoresist pattern (photocured pattern) is more difficult to remove than the positive photoresist pattern and, in addition, since it should be thick as used for copper post (bump) formation, and therefore it is further more difficult to remove by stripping. Accordingly, it is desired that such a hardly-removable thick negative photoresist could be removed more easily. In addition, it is also desired that the metal (copper) is damaged little by the removing treatment.

Most photoresist stripping solutions that have heretofore been used in production of liquid-crystal panels and semiconductor devices are water-based photoresist stripping solutions that comprise a polar solvent, an amine (including quaternary ammonium salts) and water (e.g., see Patent References 1 and 2). However, these stripping solutions contain water and therefore their damage to metal materials is inevitable, and, in addition, there are other problems in that they have some negative influences of coloration and swelling on acrylic transparent films that are used in liquid-crystal displays.

Patent Reference 1: JP-A 2001-215736

Patent Reference 2: JP-A 10-239865

SUMMARY OF THE INVENTION

The invention has been made in consideration of the above-mentioned situation, and its object is to provide a photoresist stripping solution having the advantages in that it has no problem of swelling and coloration to acrylic transparent films used in producing liquid-crystal panels, it causes no damage to electrode materials, it has good photoresist-stripping capability and its ability to strip a thick-film negative photoresist used in producing semiconductor chip packages (especially W-CSP) is good, not damaging copper.

In order to solve the above-mentioned problems, the invention provides a photoresist stripping solution consisting essentially of (a) a quaternary ammonium hydroxide, (b) at least one water-soluble organic solvent selected from glycols and glycol ethers, and (c) a non-amine water-soluble organic solvent.

The invention also provides a photoresist stripping solution used in producing liquid-crystal panels, which is for stripping a photoresist pattern formed on a transparent insulating film provided on a glass substrate.

The invention also provides a photoresist stripping solution used in producing semiconductor chip packages, which is for stripping a photoresist pattern formed on a thin metal film-having substrate after formation of a conductive layer thereon in the area where the photoresist pattern is not formed (thin metal film-exposed area).

DETAILED DESCRIPTION OF THE INVENTION

The invention is described in detail hereinunder.

The quaternary ammonium hydroxide for component (a) is preferably a compound of the following general formula (I):

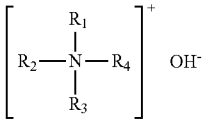

(I)

wherein $R_1$, $R_2$, $R_3$ and $R_4$ each independently represent an alkyl or hydroxyalkyl group having from 1 to 6 carbon atoms.

Concretely, the quaternary ammonium hydroxide includes tetramethylammonium hydroxide (=TMAH), tetraethylammonium hydroxide, tetrapropylammonium hydroxide, tetrabutylammonium hydroxide, tetrapentylammonium hydroxide, monomethyltripropylammonium hydroxide, trimethylethylammonium hydroxide, (2-hydroxyethyl)trimethylammonium hydroxide, (2-hydroxyethyl)triethylammonium hydroxide, (2-hydroxyethyl)tripropylammonium hydroxide, (1-hydroxypropyl)trimethylammonium hydroxide. Of those, preferred are TMAH, tetraethylammonium hydroxide, tetrapropylammonium hydroxide, tetrabutylammonium hydroxide, monomethyltripropylammonium hydroxide, (2-hydroxyethyl)trimethylammonium hydroxide, as they are easily available and are safe in use. One or more such components (a) may be used herein.

Glycols and glycol ethers are used for component (b). Concretely, they include ethylene glycol, ethylene glycol monomethyl ether, ethylene glycol monoethyl ether, ethylene glycol monobutyl ether, ethylene glycol monomethyl ether acetate, ethylene glycol monoethyl ether acetate, diethylene glycol; diethylene glycol monoalkyl ethers (in which the alkyl is a lower alkyl having from 1 to 6 carbon atoms), such as diethylene glycol monomethyl ether, diethylene glycol monoethyl ether, diethylene glycol monopropyl ether, diethylene glycol monobutyl ether (=butyl diglycol); and propylene glycol, to which, however, the invention should not be limited. Of those, preferred are ethylene glycol, propylene glycol and diethylene glycol monobutyl ether as their ability to prevent swelling and erosion is good and they are inexpensive. One or more such components (b) may be used herein.

A non-amine water-soluble organic solvent is used for component (c). Concretely, it includes sulfoxides, such as dimethyl sulfoxide; sulfones, such as dimethyl sulfone, diethyl sulfone, bis(2-hydroxyethyl)sulfone, tetramethylene sulfone; amides, such as N,N-dimethylformamide, N-methylformamide, N,N-dimethylacetamide, N-methylacetamide, N,N-diethylacetamide; lactams, such as N-methyl-2-pyrrolidone, N-ethyl-2-pyrrolidone, N-propyl-2-pyrrolidone, N-hydroxymethyl-2-pyrrolidone, N-hydroxyethyl-2-pyrrolidone; imidazolidinones, such as 1,3-dimethyl-2-imidazolidinone, 1,3-diethyl-2-imidazolidinone, 1,3-diisopropyl-2-imidazolidinone, to which, however, the invention should not be limited. One or more such components (c) may be used herein.

The photoresist stripping solution of the invention consists essentially of the three components of (a) to (c), not containing water. If it contains water as its constitutive component, then its ability to prevent erosion of wiring materials (metal) is poor and its photoresist-stripping capability is also poor. In addition, it does not also contain amines (alkanolamines) as the water-soluble organic solvent to be therein.

Not detracting from the effect of the invention, the photoresist stripping solution of the invention may contain other additive components such as surfactant and anti-corrosive. The surfactant includes amine-based surfactants substituted with an alkyl or oxyalkyl group having at least 10 carbon atoms, acetylene alcohol-based surfactants, and diphenyl ether-based surfactants substituted with at least one alkyl group having at least 7 carbon atoms, to which, however, the invention should not be limited. The anti-corrosive includes aromatic hydroxy compounds (e.g., pyrocatechol, tertbutylcatechol, pyrogallol, gallic acid), triazole compounds (e.g., benzotriazole), mercapto group-containing compounds (e.g., 1-thioglycerol, 2-mercaptoethanol), glycoalcohols (e.g., xylitol, sorbitol), to which, however, the invention should not be limited.

The photoresist stripping solution of the invention is advantageously usable for photoresists developable with an aqueous alkaline solution, including negative and positive photoresists. The photoresists of the type include (i) positive photoresists containing a naphthoquinone diazide compound and a novolak resin; (ii) positive photoresists containing a compound capable of generating an acid through exposure to light, a compound capable of increasing its solubility in aqueous alkaline solutions through decomposition by acid, and an alkali-soluble resin; (iii) positive photoresists containing a compound capable of generating an acid through exposure to light, and an alkali-soluble resin that has a group capable of being decomposed by acid to increase its solubility in aqueous alkaline solutions through; and (iv) negative photoresists containing a compound capable of generating an acid or radical through exposure to light, a crosslinking agent, and an alkali-soluble resin, to which, however, the invention should not be limited.

The photoresist stripping solution of the invention, consisting essentially of the above-mentioned components (a) to (c), is especially favorably used in a process of producing liquid-crystal panels and in a process of producing semiconductor chip packages (in particular, W-CSP).

In a process of producing liquid-crystal panels, the photoresist preferred for use is the above-mentioned (i) novolak-based positive photoresist.

In a process of producing semiconductor chip packages (especially, W-CSP), the photoresist preferred for use is a negative photoresist capable of polymerizing through irradiation with radiation rays to be insoluble in alkali, such as the above-mentioned (iv) photocurable negative photoresist.

[Photoresist Stripping Solution for Use in Production of Liquid-Crystal Panels]

In case where the photoresist stripping solution of the invention is used in a process of producing liquid-crystal panels, it is especially desirable that TMAH is used for component (a), at least any one of ethylene glycol, propylene glycol and diethylene glycol monobutyl ether is used for component (b), and dimethyl sulfoxide (DMSO) is used alone for component (c).

Preferred proportions of the constitutive components of the photoresist stripping solution favorable for use in production of liquid-crystal panels are mentioned below.

The proportion of component (a) is preferably from 0.1 to 10% by mass, more preferably from 1 to 10% by mass. If the proportion of component (a) is too small, then the photoresist dissolution and stripping may be retarded; but on the other hand, even if it is larger than the range, the increase in the proportion would not be effective any more but rather it may promote the dissolution of metal wiring materials.

The proportion of component (b) is preferably from 5 to 40% by mass, more preferably from 15 to 40% by mass. If the proportion of component (b) is too small, then the solution could not effectively prevent transparent insulating films (acrylic transparent films) from being swollen; but on the other hand, if too large, then the ability of the solution to dissolve photoresists may be poor and therefore much unremoved photoresist may remain after the treatment with the solution.

The proportion of component (c) is preferably from 50 to 95% by mass, more preferably from 50 to 80% by mass. If the proportion of component (c) is too small, then the ability of the solution to strip photoresists may lower; but if too large, then the solution may swell transparent insulating films.

In producing liquid-crystal panels such as TFT-LCD, the photoresist stripping solution of the invention may be used, for example, as follows:

TFT (thin-film transistor) equipped with a gate electrode, a drain electrode and a source electrode is formed on a glass substrate, and a transparent insulating film is superposed on the entire surface of the glass substrate to completely cover the TFT, thereby forming a planarized layer thereon.

Not specifically defined, the transparent insulating film may be any one capable of being used in production of liquid-crystal panels, for which, however, preferred is an acrylic transparent film.

Next, a transparent conductive layer is formed on the surface-planarized transparent insulating film by sputtering or the like. Preferred examples for the transparent conductive film are ITO, ITO/IZO, etc.

Next, a photoresist-forming liquid is applied onto it and dried to form a photoresist layer thereon, and then this is exposed to light and developed to form a photoresist pattern, and thereafter the transparent conductive layer is etched through the photoresist pattern serving as a mask to thereby form a pixel electrode (transparent electrode) pattern.

Not specifically defined, the formation, exposure to light, development and etching of the photoresist layer are all known techniques. The etching may be any of wet etching or dry etching.

Though not specifically defined, the above-mentioned novolak-based positive photoresist is preferred for the photoresist-forming liquid.

Next, the photoresist pattern is stripped away, using the photoresist stripping solution of the invention. The stripping treatment with the stripping solution of the invention may be attained generally by dipping or showering. Not specifically defined, the time for the stripping treatment may be enough for photoresist pattern removal, but is preferably from 1 to 20 minutes or so.

After the stripping treatment, the substrate may be rinsed with pure water or lower alcohol that is generally used for it, and may be then dried.

In the stripping treatment, the photoresist stripping solution is brought into contact with the acrylic transparent film, but the stripping solution of the invention may effectively strip and remove the photoresist pattern, not having any negative influence of swelling or coloration on the acrylic transparent film. Accordingly, the treatment with the stripping solution of the invention does not cause any problem of peeling of transparent electrodes and does not detract from the transparency of the acrylic film.

[Photoresist Stripping Solution for Use in Production of Semiconductor Chip Packages]

In case where the photoresist stripping solution of the invention is used in a process of producing semiconductor chip packages (in particular, W-CSP), it is especially desirable that TMAH is used for component (a), propylene glycol is used for component (b), and a single solvent of dimethyl sulfoxide (DMSO) or a mixed solvent of dimethyl sulfoxide (DMSO) and N-methyl-2-pyrrolidone (NMP) in a ratio, DMSO/NMP is at least 1.9 (by mass), preferably at least 5.5 (by mass), more preferably at least 7.0 (by mass) is used for component (c). Using DMSO alone or using a mixed solvent of DMSO with NMP of more than a predetermined proportion, the solution may have an especially excellent photoresist-stripping capability for negative photoresists. If the ratio DMSO/NMP is less than 1.9 (by mass), then the photoresist-stripping capability of the solution may be poor and some unremoved photoresist may remain after the treatment with the solution.

Preferred proportions of the constitutive components of the photoresist stripping solution favorable for use in production of semiconductor chip packages are mentioned below.

The proportion of component (a) is preferably from 0.5 to 5% by mass, more preferably from 0.5 to 3% by mass. If the proportion of component (a) is too small, then the photoresist dissolution and stripping may be retarded; but on the other hand, if too large, then copper dissolution with the solution may be promoted.

The proportion of component (b) is preferably from 5 to 30% by mass, more preferably from 5 to 15% by mass. If the proportion of component (b) is too small, then the solution may erode copper; but on the other hand, if too large, then the ability of the solution to dissolve photoresists may be poor and therefore much unremoved photoresist may remain after the treatment with the solution.

The proportion of component (c) is preferably from 65 to 95% by mass, more preferably from 70 to 90% by mass. If the proportion of component (c) is too small or too large, then the ability of the solution to strip photoresists may lower.

In producing semiconductor chip packages (especially, W-CSP), the photoresist stripping solution of the invention may be used, for example, as follows:

A conductive thin metal film is formed on a substrate such as silicon wafer having a passivation film (insulating film) formed thereon, by sputtering or the like. In particular, in the process of producing W-CSP, the conductive thin metal film is preferably a thin copper (Cu) film. In the invention, copper (Cu) is not limited to pure copper alone but is meant to include all copper-based alloys.

Next, a positive photoresist pattern is provided on the thin copper film, and the thin copper film is etched through the pattern serving as a mask to form a copper rerouting pattern. One or more layers of the insulating film/copper rerouting pattern are formed as a single-layer or multi-layer structure.

Next, a photosensitive dry film of a negative photoresist is stuck to the copper rerouting pattern-having substrate under heat and pressure, then this is selectively exposed to light and developed to form a thick-film photoresist pattern (photocured pattern). Next, a copper post (bump) is formed in the area not having the photoresist pattern, by plating, and thereafter the photoresist pattern is removed with the stripping solution of the invention. Though depending on the height of the copper post formed, the photocured pattern may be generally from 20 to 150 μm thick. The height of the copper post may be generally at least 20 μm.

Using the photoresist stripping solution of the invention, the photoresist pattern is stripped away. The stripping treatment with the stripping solution of the invention may be attained generally by dipping or showering. Not specifically defined, the time for the stripping treatment may be enough for photoresist pattern removal. However, since the photoresist pattern in this case is more difficult to dissolve and strip than a positive photoresist and since the photoresist pattern is thick, the time for the stripping treatment is preferably from 30 to 90 minutes or so.

Next, this is sealed up with a sealant resin to cover the entire surface of the substrate so as to completely cover the copper post, and thereafter the upper part of the sealant resin and the upper part of the copper post are all cut off. A conductive terminal (copper terminal) is soldered to the top of the thus-cut and exposed copper post, and thereafter the wafer is cut into individual packages.

In the above-mentioned stripping treatment for stripping the hardly-strippable negative photoresist in which the photoresist pattern must be made thick for the formation of the copper post (bump) that must have a height not smaller than a predetermined level and in which the thick photoresist pattern is more difficult to strip, the hardly-strippable, thick photoresist pattern can be favorably stripped away by the use of the photoresist stripping solution of the invention, and in this treatment, the stripping solution of the invention does neither erode nor dissolve copper.

EXAMPLES

The invention is described in more detail with reference to the following Examples, to which, however, the invention should not be limited.

Examples 1 to 5, Comparative Examples 1 to 4

Stripping solutions each having the composition shown in Table 1 below were prepared. These were tested in the following test methods for their photoresist strippability and for their side effects of damaging (swelling/coloring) acrylic transparent films and eroding metal wiring (Al-based wiring) materials. The results are given in Table 2.

[Photoresist Strippability]

A positive photoresist, TFR-1070 (by Tokyo Ohka Kogyo Co., Ltd.) comprising a naphthoquinonediazide compound and a novolak resin is applied onto a silicon substrate, using a spinner, and pre-baked at 110° C. for 90 seconds to form thereon a photoresist layer having a thickness of 1.5 μm. Through a mask pattern, the photoresist layer is exposed to light, using an exposing device NSR-1505G7E (by Nikon Corp.), and then developed with an aqueous 2.38 mas. % tetramethylammonium hydroxide (TMAH) solution to form a photoresist pattern. Next, this is post-baked at 140° C. for 90 seconds.

Next, the substrate having the photoresist pattern formed under the condition as above is dipped in a photoresist stripping solution (at 60° C.) shown in Table 1 below for 1 minute, and then observed with a scanning electronic microscope (SEM) for evaluating the photoresist strippability according to the evaluation standards mentioned below.

(Evaluation)

S: Photoresist completely removed.

A: Photoresist remained but a little.

B: Some photoresist remained.

[Damage (swelling/coloration) to Acrylic Transparent Film]

An acrylic transparent film is formed on a silicon substrate, using a spinner, and pre-baked at 95° C. for 110 seconds. Then, its surface is completely exposed to G-line rays, H-line rays and I-line rays, and baked at 230° C. for 30 minutes.

Thus processed, the substrate is dipped in a photoresist stripping solution (at 60° C.) shown in Table 1 below for 5 minutes. Using a NanoSpec, the degree of swelling and the degree of coloration of the tested sample are measured, and the sample is evaluated according to the evaluation standards mentioned below.

(Evaluation)

S: Swelling/coloration was extremely small.

A: Swelling/coloration was small.

B: Swelling/coloration was great.

[Erosion of Al-Based Wiring Material]

An Al—Si—Cu layer (150 nm thick) is formed on a silicon substrate, and the substrate is dipped in a photoresist stripping solution (at 60° C.) shown in Table 1 below for 10 minutes, and then its sheet resistivity is measured. From the data, obtained is the film loss (etched amount) of the Al—Si—Cu layer. From this, the ability of the stripping solution to prevent the erosion of the Al—Si—Cu layer is evaluated according to the evaluation standards mentioned below. The sheet resistivity is measured, using VR-70 (by Kokusai Electric Inc.).

(Evaluation)

A: Not eroded.

B: Eroded.

TABLE 1

| | Photoresist stripping solution (mas. %) | | |
|---|---|---|---|
| | Component (a) | Component (b) | Component (c) |
| Example 1 | TMAH (0.5) | EG (35) | DMSO (64.5) |
| Example 2 | TMAH (2) | PG (18) | DMSO (80) |
| Example 3 | TMAH (8) | EG (10) | DMSO (82) |
| Example 4 | TMAH (10) | PG (40) | DMSO (50) |
| Example 5 | TMAH (1) | BDG (9) | DMSO (90) |
| Comparative Example 1 | TMAH (0.05) | EG (20) | DMSO (79.95) |
| Comparative Example 2 | TMAH (15) | BDG (30) | DMSO (55) |
| Comparative Example 3 | TMAH (2) | PG (50) | DMSO (48) |
| Comparative Example 4 | TMAH (4) | PG (1) | DMSO (95) |

Notes:
TMAH: tetramethylammonium hydroxide
EG: ethylene glycol
PG: propylene glycol
DMSO: dimethyl sulfoxide
BDG: diethylene glycol monobutyl ether (=butyl diglycol)

TABLE 2

| | Photoresist Strippability | Damage to Acrylic Transparent Film | Erosion of Al-based Wiring Material |
|---|---|---|---|
| Example 1 | A | S | A |
| Example 2 | S | S | A |
| Example 3 | S | A | A |
| Example 4 | S | S | A |
| Example 5 | S | A | A |
| Comparative Example 1 | B | A | A |
| Comparative Example 2 | A | A | B |
| Comparative Example 3 | B | S | A |
| Comparative Example 4 | S | B | B |

Examples 6-10, Comparative Examples 5-8

Stripping solutions each having the composition shown in Table 3 below were prepared. These were tested in the following test methods for their photoresist strippability and for their side effects of copper dissolution and copper oxidation. The results are given in Table 4.

[Photoresist Strippability]

A photoresist dry film of negative photoresist (ORDYL, by Tokyo Ohka Kogyo Co., Ltd.) is laminated on a wafer having thereon a rerouting copper pattern formed of a sputtered copper film. Though a mask pattern, the negative photoresist dry film is selectively exposed to light, and developed with a sodium carbonate solution to give a photoresist pattern (thickness: 120 μm).

Next, a copper post (height: 120 μm) is formed in the area not having the photoresist pattern, by electroplating.

The thus-processed substrate is dipped in a photoresist stripping solution (at 60° C.) shown in Table 3 below for 60 minutes, and then observed with a scanning electronic microscope (SEM) for evaluating the photoresist strippability according to the evaluation standards mentioned below.

(Evaluation)

S: Photoresist completely removed.

A: Photoresist remained but a little.

B: Some photoresist remained.

[Copper Dissolution]

A substrate with a sputtered copper film formed thereon is dipped in a photoresist stripping solution (at 60° C.) shown in Table 3 below for 60 minutes, and then observed with a scanning electronic microscope (SEM) for evaluating the surface condition and the degree of copper dissolution of the sample, and the sample is evaluated according to the evaluation standards mentioned below.

(Evaluation)

S: No copper dissolution found.

A: Copper dissolution found but a little.

B: Some copper dissolution found.

[Copper Oxidation]

A substrate with a sputtered copper film formed thereon is dipped in a photoresist stripping solution (at 60° C.) shown in Table 3 below for 60 minutes, and then the sheet resistivity of the sputtered copper film is measured to evaluate the degree of copper oxidation. The results are given in Table 4. The sheet resistivity is measured with VR-70 (by Kokusai Electric Inc.).

(Evaluation)

S: Little copper oxidation found.

A: Copper oxidation found but a little.

B: Some copper oxidation found.

TABLE 3

| | Photoresist stripping solution (mas. %) | | | |
|---|---|---|---|---|
| | Component (a) | Component (b) | Component (c) | Others |
| Example 6 | TMAH (2) | PG (10) | DMSO (78) + NMP (10) | — |
| Example 7 | TMAH (2.5) | PG (10) | DMSO (77.5) + NMP (10) | — |
| Example 8 | TMAH (2) | PG (20) | DMSO (58) + NMP (10) | — |
| Example 9 | TMAH (2) | PG (10) | DMSO (88) | — |
| Example 10 | TMAH (2) | PG (10) | DMSO (58) + NMP (30) | — |
| Comparative Example 5 | TMAH (8) | PG (10) | DMSO (72) + NMP (10) | — |
| Comparative Example 6 | TMAH (2) | PG (40) | DMSO (48) + NMP (10) | — |
| Comparative Example 7 | TMAH (2) | PG (10) | DMSO (28) + NMP (60) | — |
| Comparative Example 8 | TMAH (2) | PG (10) | DMSO (73) + NMP (10) | water (5) |

Notes:
TMAH: tetramethylammonium hydroxide
PG: propylene glycol
DMSO: dimethyl sulfoxide
NMP: N-methyl-2-pyrrolidone

TABLE 4

| | Photoresist Strippability | Copper Dissolution | Copper Oxidation |
|---|---|---|---|
| Example 6 | S | S | S |
| Example 7 | S | S | S |
| Example 8 | A | S | S |
| Example 9 | S | S | S |
| Example 10 | A | S | A |
| Comparative Example 5 | B | S | S |
| Comparative Example 6 | B | S | S |
| Comparative Example 7 | B | S | S |
| Comparative Example 8 | S | A | B |

As obvious from the results in Tables 2 and 4, the photoresist stripping solutions of the invention have good photoresist strippability, not causing damage of swelling or coloration to the acrylic transparent film that is used in production of liquid-crystal panels, and, in addition, they are excellent in stripping the thick-film negative photoresist that is used in production of W-CSP packages and have a good ability to prevent copper erosion.

As described in detail hereinabove, the photoresist-stripping solution of the invention can be used both in production of liquid-crystal panels and in production of semiconductor chip packages (especially, W-CSP), and has a good photoresist strippability, not causing damage of swelling or coloration to acrylic transparent films that are used in production of liquid-crystal panels and not causing damage to electrode materials. In particular, the photoresist stripping solution of the invention has a good photoresist strippability to remove even a thick-film negative photoresist used in production of W-CSP, not causing damage to copper.

What is claimed is:

1. A photoresist stripping solution consisting essentially of (a) 0.1 to 10% by mass of a quaternary ammonium hydroxide, (b) 5 to 40% by mass of at least one water-soluble organic solvent selected from glycols and glycol ethers, and (c) 50 to 95% by mass of a non-amine water-soluble organic solvent, wherein:

the photoresist stripping solution does not contain water, and the component (c) is dimethyl sulfoxide (DMSO).

2. The photoresist stripping solution of claim 1, wherein component (a) is a compound of the following general formula (I):

(I)

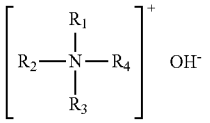

wherein $R_1$, $R_2$, $R_3$ and $R_4$ each independently represent an alkyl or hydroxyalkyl group having from 1 to 6 carbon atoms.

3. The photoresist stripping solution of claim 1, wherein component (b) is at least one selected from ethylene glycol, propylene glycol and diethylene glycol monobutyl ether.

4. The photoresist stripping solution of claim 1, which is used in a process of producing liquid-crystal panels for stripping a photoresist pattern formed on a transparent insulating film provided on a glass substrate.

5. The photoresist stripping solution of claim 4, wherein the transparent insulating film is an acrylic transparent film.

6. A photoresist stripping solution consisting essentially of (a) 0.5 to 5% by mass of a quaternary ammonium hydroxide, (b) 5 to 30% by mass of at least one water-soluble organic solvent selected from glycols and glycol ethers, and (c) 65 to 95% by mass of a non-amine water-soluble organic solvent, wherein:

the photoresist stripping solution does not contain water, and the component (c) is a single solvent of dimethyl sulfoxide (DMSO) or a mixed solvent of dimethyl sulfoxide (DMSO) and N-methyl-2-pyrrolidone (NMP) in a mass ratio of DMSO/NMP of at least 1.9.

7. The photoresist stripping solution of claim 6, which is used in a process of producing semiconductor chip packages for stripping a photoresist pattern formed on a thin metal film-having substrate after formation of a conductive layer thereon in the area where the photoresist pattern is not formed (thin metal film-exposed area).

8. The photoresist stripping solution of claim 7, wherein the thin metal layer and the conductive layer are formed of copper.

9. The photoresist stripping solution of claim 7, wherein the photoresist pattern is a photocured pattern formed by the use of a negative photoresist composition capable of polymerizing through irradiation with radiation rays to be insoluble in alkali.

* * * * *